United States Patent [19]

Robinson, Jr.

[11] Patent Number: 5,052,187

[45] **Date of Patent: * Oct. 1, 1991**

[54] WATER FLOW CONTROL FOR HEAT PUMP WATER HEATERS

[76] Inventor: Glen P. Robinson, Jr., 1050 Mt. Paran Rd., SW., Atlanta, Ga. 30327

[ * ] Notice: The portion of the term of this patent subsequent to Sep. 11, 2007 has been disclaimed.

[21] Appl. No.: 528,704

[22] Filed: May 24, 1990

Related U.S. Application Data

[63] Continuation-in-part of Ser. No. 384,148, Jul. 21, 1989, Pat. No. 4,955,930.

[51] Int. Cl.[5] ..... F25B 7/00

[52] U.S. Cl. ..... 62/79; 62/175; 62/238.6; 62/238.7; 237/2 B

[58] Field of Search ..... 62/79, 175, 238.6, 238.7; 237/2 B

[56] References Cited

U.S. PATENT DOCUMENTS 4,955,930 9/1990 Robinson, Jr. ..... 62/79

*Primary Examiner*—Lloyd L. King

*Attorney, Agent, or Firm*—B. J. Powell

[57] ABSTRACT

A heat pump for heating water in a condenser where the water is circulated through the condenser by a pump controlled by the condensing temperature of the refrigerant to return water heated to a usable temperature to the upper end of the water tank.

15 Claims, 2 Drawing Sheets

WATER FLOW CONTROL FOR HEAT PUMP WATER HEATERS

CROSS REFERENCE TO RELATED APPLICATIONS

This application is a continuation-in-part of my copending application Ser. No. 07/384,148, filed July 21, 1989, now U.S. Pat. No. 4,955,930.

BACKGROUND OF THE INVENTION

This invention relates generally to heating devices for water heaters; and more particularly to a heat pump used to heat the water in a water heater. Heat pumps have been used before to heat water for water heating installations. Examples of these uses are illustrated in the following United States Patents:

| U.S. Pat. No. | Issued | Inventor | Class/ Subclass |
|---|---|---|---|
| 2,575,325 | 11/1951 | Ambrose et. al. | 62/238 E |
| 2,668,420 | 2/1954 | Hammell | 62/238 E |
| 3,922,876 | 12/1975 | Wetherington, Jr., et. al. | 62/238 EX |
| 4,073,285 | 2/1978 | Wendel | 62/238.6 |
| 4,136,731 | 1/1979 | DeBoer | 165/12 |
| 4,141,222 | 2/1979 | Ritchie | 62/238 E |
| 4,142,379 | 3/1979 | Kuklinski | 62/238.6 |
| 4,330,379 | 5/1982 | Robinson, Jr. | 62/181 |

Typically early prior art heat pumps for water heaters employed thermally operated flow control valves to restrict the rate of water flow through the heat pump to assure that the outlet water reached a sufficiently high temperature so that the heated water could be returned to the top of a water storage tank and be available for immediate use. Usually, water was drawn from the bottom of the tank through the dip tube on the cold water inlet at the top of the tank which extends down to the lower end of the tank. The heated water was returned to the top of the tank after being heated. A water circulating pump associated with the heat pump was required to provide a flow rate of approximately 2 GPM per 12,000 BTUH to maintain sufficient heat transfer to extract the heat from the condenser without exceeding the condensing temperature limit of the compressor as the water approached its final tank temperature.

The prior art flow control valves were very similar to the thermostat in an automobile radiator system. A bleed hole allowed a small amount of water to flow through the heat pump condenser heat exchanger when the water from the water tank was cold. This allowed the flow control valve to sense the temperature of the water leaving the heat pump. Typically, the valve would begin to open as the water approached about 115° F. and was fully open at about 125° F. During an initial tank heat up or after a batch of hot water was withdrawn, the flow control valve would modulate the water flow rate to maintain an outlet temperature of approximately 120° F. until the entire tank began to heat up. As the water entering the heat pump from the bottom of the tank began to warm, the output of the heat pump would raise the temperature of the water higher than 120° F. causing the flow control valve to open further to increase the flow rate until the maximum flow rate was reached. The system continued to operate until the tank was heated to its set point as controlled by the tank thermostat, usually about 140° F.

The advantage of this system was that it heated the water tank from the top down making some hot water instantaneously available before a tank was completely heated to an acceptable temperature. Unfortunately, this type flow control valve experienced serious reliability problems from corrosion, scaling, and plugging. Other types of flow control valves were also found to either be too expensive and/or unreliable to be practical. Because of the problems, this concept of using variable flow control was about abandoned in the mid-1980's.

SUMMARY OF THE INVENTION

These and other problems and disadvantages associated with the prior art are overcome by the invention disclosed herein by providing a heat pump for heating the water in a water heater which has a high temperature hot water recovery without requiring the use of flow control valves. This allows the advantages associated with prior art heat pumps with flow control to be achieved more reliably and economically.

The apparatus of the invention includes generally a water tank which contains the water to be heated with the water in the lower level of the tank circulated through the condenser heat exchanger in a heat pump located externally of the water tank by a circulation means such as a pump so that water from the bottom of the water tank can be circulated through the condenser heat exchanger to heat the water and then back into the top of the water tank. Refrigerant temperature operated control means is provided for letting the water remain in the condenser heat exchanger until the water in the condenser heat exchanger reaches a predetermined return temperature so that the water returned to the top of the water tank is at least at the predetermined return temperature. The predetermined temperature is selected to be hot enough for immediate use by the user. Because the water in the water tank naturally stratifies with the hotter water being at the top, the hot water being returned from the condenser heat exchanger in the heat pump can be immediately used by the user of the invention. The control means may be a temperature operated switch which controls the circulation pump operation. The switch is set to operate the pump when the refrigerant temperature in the condenser reaches a value corresponding to the desired return water temperature and to stop pump operation when the refrigerant temperature drops a specified amount. This discharges the water intermittently in pulses from the condenser into the tank as each condenser full of water is heated. When the water from the water tank into the condenser reaches a temperature where the condenser can heat the water at least to the return temperature without stopping the pump, the pump continues to run until the heat pump is turned off when the desired tank temperature is reached. These and other features and advantages of the invention will become more clearly understood upon consideration of the following specification and accompanying drawings wherein like characters of reference designate corresponding parts through the several views and in which:

These figures in the following detailed description disclose specific embodiments of the invention; however, the inventive concept is not limited thereto since it may be embodied in other forms.

DETAILED DESCRIPTION OF ILLUSTRATIVE EMBODIMENTS

Figure 1:
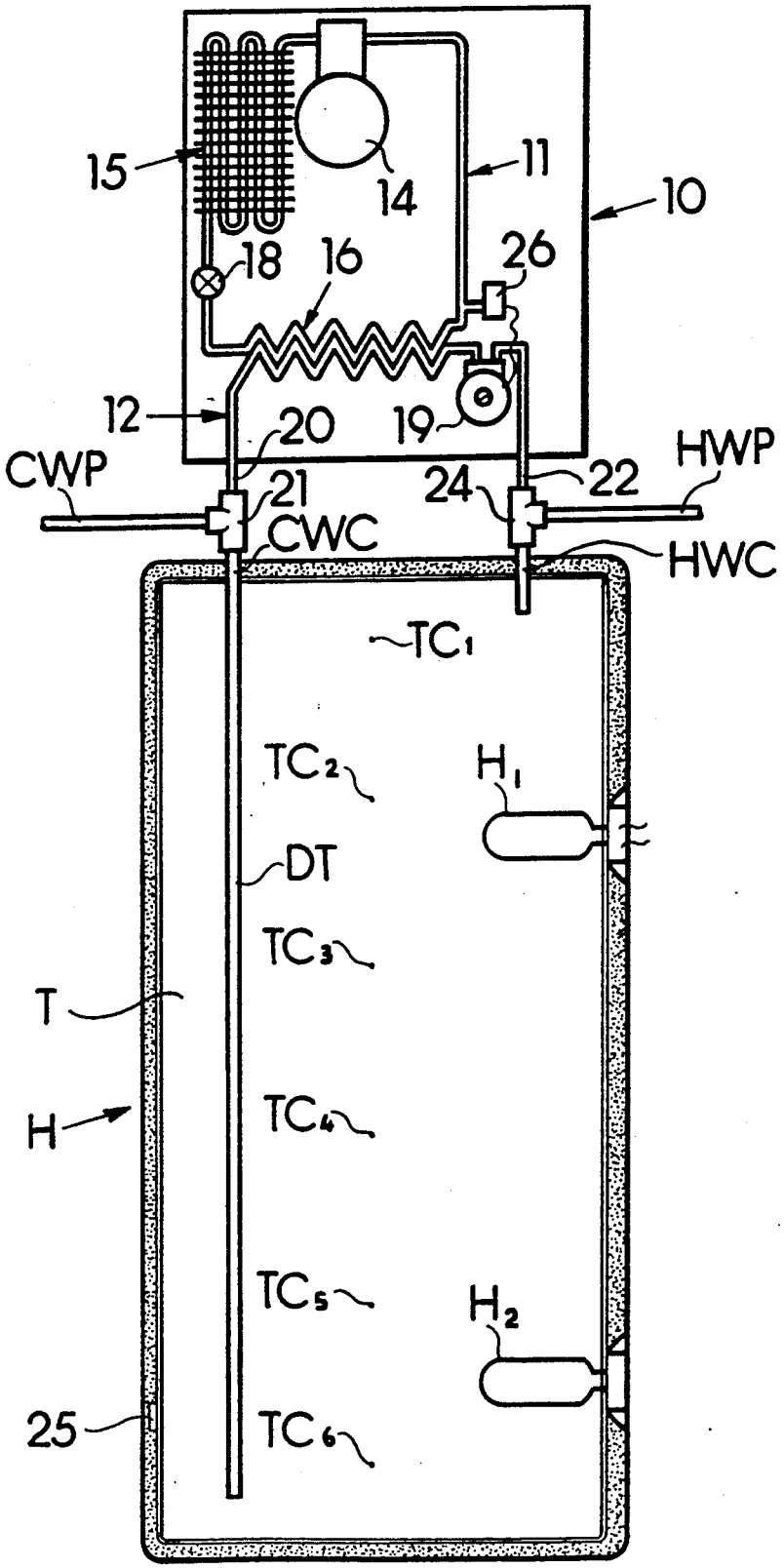
FIG. 1 schematically illustrates the invention connected to the hot water tank.

FIG. 1 schematically illustrates the invention utilizing an existing water heater H with electrical resistance upper and lower heating elements $H_1$ and $H_2$ respectively. The resistance heating elements are disabled while the invention is being used. The water heater H is of conventional construction with a generally vertically oriented water tank T having a cold water connection CWC and a hot water connection HWC both located at the upper end of the tank T. The cold water connection CWC has a dip tube DT that extends from the top of the tank down to a position adjacent the bottom of the tank so that incoming cold water is delivered to the bottom of the water tank as is conventional. The hot water connection HWC, on the other hand, opens into the upper end of the tank T. Because the water in the upright tank naturally stratifies according to temperature with the hottest temperature being at the upper end, the hottest temperature water in the tank is withdrawn through the hot water connection HWC.

The heating unit 10 illustrated in the drawings includes a heat pump loop 11 and a water circulation loop 12. The heat pump loop 11 includes a conventional compressor 14 with its suction side connected to an evaporator heat exchanger 15 illustrated as an air-to-refrigerant heat exchanger and fan and with its high pressure side connected to a condenser heat exchanger 16 shared with the water circulation loop 12. The condenser heat exchanger 16 is a refrigerant-to-liquid heat exchanger. The refrigerant in the heat pump loop passes through the refrigerant side of the condenser heat exchanger 16 while the water in the water circulation loop 12 passes through the water side of the condenser heat exchanger 16 as will become more apparent. The refrigerant side of the condenser heat exchanger 16 is connected to the evaporator heat exchanger 15 through the conventional expansion device 18.

The water circulation loop 12 includes the condenser heat exchanger 16 shared with the heat pump 11 and a water pump 19. The intake pipe 20 to the water circulation loop 12 is connected to the cold water connection CWC through a tee fitting 21 which also serves to connect the cold water supply pipe CWP to the cold water connection CWC. Similarly, the discharge pipe 22 from the water circulation loop 12 is connected to the hot water connection HWC through a tee fitting 24. The tee fitting 24 also serves to connect the hot water supply pipe HWP to the hot water connection HWC. As will become more apparent, these connections permit the cold water from the cold water supply pipe CWP to enter the tank as hot water is drawn off, while at the same time allowing the water circulation loop 12 to withdraw the cold water from the bottom of the tank. Similarly, hot water is drawn out of the top of the tank through the connection HWC and the heated water from the water circulation loop 12 is returned to the top of the tank through the same connection.

The overall operation of the heating unit 10 is controlled by a tank thermostat 25 located so as the sense tank water temperature adjacent the lower end thereof. Thermostat 25 may be the conventional lower thermostat associated with the heating elements $H_1$ and $H_2$ in a conventional electric water heater or may be a separate thermostat. The thermostat 25 is typically designed to open when the tank water temperature at its location reaches the set point of the thermostat and will close when the tank water temperature drops a prescribed amount below the set point temperature. The set point temperature for the thermostat 25 is usually lower than the final temperature of the water at the top of the tank since the water stratifies. The operation of the water circulation pump 19 is controlled by a refrigerant temperature switch 26 connected to the heat pump loop 11 so as to sense refrigerant condensing temperature. Temperature switch 25 has a configuration to close when the refrigerant condenser temperature reaches a preset value and opens when the condenser temperature drops a predetermined value below its preset point.

The maximum water temperature to which the heating unit 10 can heat the water is established by the maximum safe condensing temperature at which the heat pump compressor of loop 11 can operate when full condensing of the refrigerant of the condenser heat exchanger 16 takes place. Usually, a refrigerant such as Refrigerant R500 normally used in water heating applications use compressors which reliably operate at a condensing temperature of approximately 140° F. The minimum temperature at which water can be returned to the top of the water tank and be ready for immediate use is established by typical use requirements and is typically in the neighborhood of about 110°-125° F. Thus, the heating unit 10 can be operated until the water at the upper end of the tank is about 140° F. The temperature switch 26 illustrated is selected so that it closes to operate the water pump 19 when the refrigerant condensing temperature reaches about 140° F. and opens when the condensing temperature falls to about 125° F. to stop the operation of the pump 19.

OPERATION

Usually the water in the tank T is heated so that the selected water temperature is maintained at the level set by the tank thermostat 25. A typical setting is about 130° F. Because the water in the tank T tends to stratify, there will usually be a temperature gradient between the upper end of the tank T and the level of the thermostat 25 so that the temperature of the water in the upper level of the tank T is at a temperature of about 140° F.

When the user opens a tap for hot water, the hotter water at the upper end of the tank T is drawn off while fresh cold water from the supply pipe CWP enters the lower end of tank T. Because heated water stratifies extremely well if there is no agitation to cause the mixing with the cold water, the cold water remains in the lower end of the tank T. As soon as the cold water level reaches the vicinity of the tank thermostat 25 so that the temperature drops below the setting of the thermostat 25, it closes to start operation of the heating unit 10.

Closing of thermostat 25 starts the compressor 14 to supply heated refrigerant to the refrigerant side of the condenser heat exchanger 16. It will be appreciated that the water side of the condenser heat exchanger 16 always remains connected to the water tank and remains full of water. When the compressor is initially turned on, the heat exchanger 16 is cool. This cool coil causes the condensing temperature on the refrigerant side of the heat exchanger 16 to be low. The temperature switch 26 remains open, however, since the refrigerant temperature is below the set point of the temperature switch 26. This prevents the pump from operating to circulate water from the tank T. The water temperature differentials and the pipe sizes associated with the heating unit 10 are such that very little water flow occurs through the water circulation loop due to a thermosiphon affect and remains virtually stagnant until the water circulation pump 19 is operating.

The stagnant water in the condenser heat exchanger 16 will be heated as the hot refrigerant continues to flow through the exchanger by absorbing the heat output of the compressor. This causes the condensing temperature to increase rapidly. When the set point temperature of the temperature switch 26 is reached, the switch will close to operate the water pump 19. Typically, the set point temperature is about 140° F. with Refrigerant R500.

As soon as pump 19 starts to operate, the heated water is discharged into the top of the tank T and is replaced by cold water from the bottom of the tank. As the cold water starts to fill the heat exchanger 16, the temperature and thus the condensing temperature on the refrigerant side rapidly falls until it reaches the lower temperature differential permitted from the preset point. In the particular example used, this temperature differential is about 15° F. Thus, when the condensing temperature falls to about 125° F., the temperature switch 26 will open to disable the water pump 19.

Figure 3:
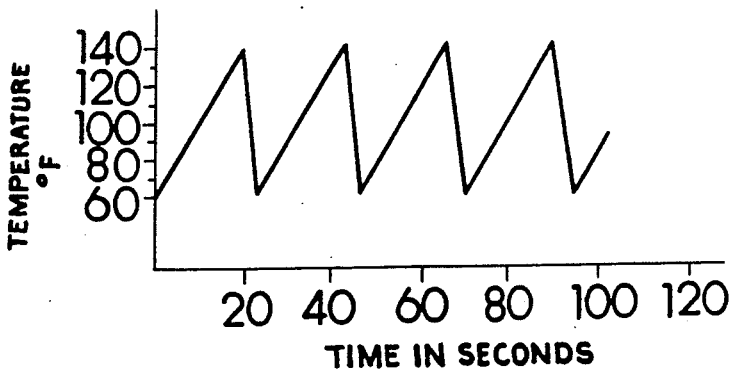

As the heat pump loop 11 continues to operate, the water pump 19 will be pulsed on and off each time the water in the condenser heat exchanger 16 is heated up to the point where the condensing temperature reaches the set point of the temperature switch 26. FIG. 3 illustrates this phenomenon. Because the water in the condenser heat exchanger 16 is quickly heated, the pump 19 will be frequently pulsed on and off during the heating cycle. In the particular example illustrated, it takes about 20 seconds for the water in the heat exchanger 16 to heat from about 60° F. to 140° F. and about 3 seconds for the pump to discharge enough of the water from the heat exchanger 16 and introduce cold water from the tank T to reduce the condensing temperature and cause the cycle to repeat. As will become more apparent, it will be seen that these short pulse cycles will continue until the water at the lower end of the tank starts to heat up from the initial cold temperature to a temperature displaced below the lowest temperature at which the temperature switch 26 keeps the pump 19 operating. Typically this is about 5°-10° F. below the lower condensing temperature at which the temperature switch 26 opens.

Figure 2:
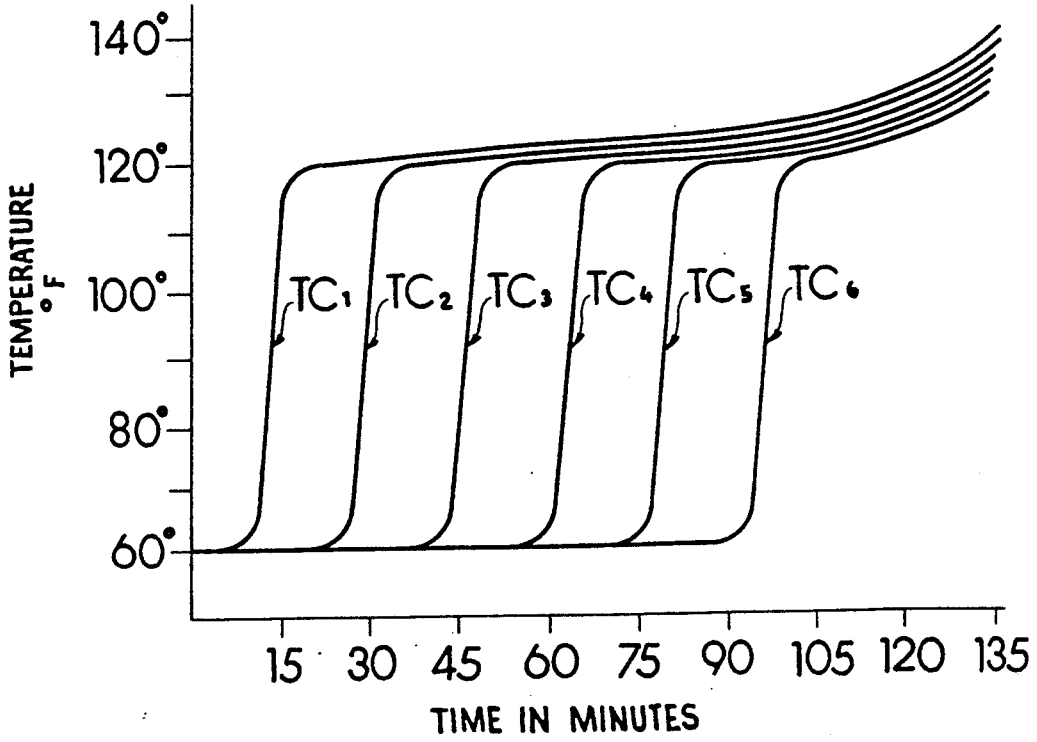
FIG. 2 is a temperature-time diagram of the water in the water tank using the invention; and, FIG. 3 is a temperature-time diagram of the water in the heat pump heat exchanger during initial heating.

Because heated water stratifies extremely well when there is no agitation to cause the mixing with cold water, there will be a distinct boundary between the hot and cold water in the tank T as hot water is drawn off the top of the tank and cold water is supplied to the bottom of the tank. Likewise, when the cold water is drawn from the bottom of the tank, heated in the heating unit 10 and returned to the top of the tank, the boundary or thermocline will remain between the hot and the cold water. This thermocline slowly moves downwardly in the tank as heating progresses. FIG. 2 illustrates the temperature of the water in various depths TC1–TC6 in the tank T as it is being heated from an initial temperature in which the entire tank is cold. The temperature at which the hot water is returned to the top of the tank from the heating unit 10, accounting for typical heat losses, is about 110°-120° F. Because of this stratification, the upper end of the tank is quickly heated to a usable temperature while a much longer time is required to heat the entire tank up to the usable temperature. The illustration used in FIG. 2 is based on a 40 gallon water tank and a 12000 BTUH heat pump. It will thus be seen that the upper end of the tank is heated to about 120° F. in about 15 minutes while it takes about 100 minutes to heat all of the tank up to this 120° F. temperature. After the tank has reached the 120° F. temperature, the water being returned from the bottom of the tank to the condenser heat exchanger 16 is at the 120° F. temperature so that the temperature switch 26 remains closed to continuously operate the pump 19. The pump then operates continuously until the final tank temperature is raised to the set point on the tank thermostat 25.

What is claimed as invention is:

1. A water heater construction for storing hot water at the normal predetermined tank temperature associated with hot water heaters including:

a water tank having an upper end, a lower end, and a cold water supply for supplying cold water to the lower end of said water tank;

a heat pump having a condenser heat exchanger externally of said water tank; circulation pump means for pumping water from the lower end of said water tank through said condenser heat exchanger to heat the water and back into the upper end of said water tank; thermostatic control means responsive to the temperature of the water at a predetermined position in said water tank and operatively connected to said heat pump, said thermostatic control means set at the normal predetermined tank temperature to operate said heat pump when the temperature of the water in said water tank at said predetermined position drops below the normal predetermined tank temperature until the temperature of the water at said predetermined position in said water tank is raised back to the normal predetermined tank temperature; and temperature sensing means operatively associated with the condenser heat exchanger refrigerant temperature and operatively connected to said circulation pump means to start operating said pump means when the condensing refrigerant temperature reaches a first prescribed value and to stop operating said pump means when the condensing refrigerant temperature drops below a second prescribed value, said first and second prescribed values selected so that water from said tank in said condenser heat exchanger will not be discharged from said heat exchanger and returned to the upper end of said water tank until a predetermined return water temperature sufficient for immediate use but below the normal predetermined tank temperature, and the discharge of the water from said heat exchanger will be stopped when the return water temperature drops significantly below said predetermined return water temperature so that the water in said water tank is first intermittently circulated through said condenser heat exchanger to heat the water to said predetermined return water temperature in batches until substantially all of the water in said water tank is at least at said predetermined return water temperature and then further circulated through said condenser heat exchanger to heat the water above said predetermined return water temperature until the water in said water tank has been heated to the normal predetermined tank temperature at said predetermined position.

2. The water heater construction of claim 1 wherein said prescribed temperature corresponds to a water temperature in said heat exchanger of about 125°-140° F.

3. The water heater construction of claim 2 wherein said second prescribed temperature is about 15° F. less than said first prescribed temperature.

4. The water heater construction of claim 2 wherein said first prescribed temperature is about 140° F.

5. The water heater construction of claim 1 wherein said temperature sensing means is a temperature responsive switch.

6. The water heater construction of claim 1 wherein the heating rate capacity of said heat pump is insufficient to maintain the water flowing through said heat exchanger at the normal predetermined tank temperature at the pumping capacity of said circulation pump so that the average temperature of the water within the heat exchanger is minimized and the heat transfer rate from the heat pump into the water is maximized.

7. A heating unit for heating water in an existing water heater having a water tank for storing water at the normal predetermined tank temperature associated with the water heater into which cold water is introduced adjacent the lower end thereof and from which hot water is withdrawn from adjacent the upper end thereof, said heating unit comprising:

a heat pump including a refrigerant-to-water heat exchanger adapted to heat water therein while said heat pump is operating, said heat exchanger connected in a water loop between the lower and upper ends of said water tank;

a circulation pump in said water loop for selectively forcing water through said heat exchanger from the lower end of said tank to the upper and thereof;

thermostatic control means responsive to the temperature of the water at a predetermined position in the water tank being below the normal predetermined tank temperature to operate said heat pump until the temperature of the water at the predetermined position in the water tank is raised back to the normal predetermined tank temperature; and, temperature control means operatively associated with the refrigerant temperature in said heat exchanger and said circulation pump to operate said circulation pump when the refrigerant temperature in said heat exchanger reaches a predetermined value and to operate said circulation pump until the refrigerant temperature drops below said predetermined value a prescribed amount.

8. The heating unit of claim 7 wherein the heating rate capacity of said heat pump is insufficient to maintain the water flowing through said heat exchanger at the normal predetermined tank temperature at the pumping capacity of said circulation pump so that the average temperature of the water within the heater exchanger is minimized and the heat transfer rate from the heat pump into the water is maximized.

9. The water heater construction of claim 8 wherein said predetermined value of refrigerant temperature corresponds to a water temperature in said heat exchanger of about 125°-140° F.

10. A method of heating water in a water tank to the normal predetermined tank temperature associated with water heaters using a heat pump with a condenser heat exchanger comprising the steps of:

a) connecting the condenser heat exchanger between the upper and lower ends of the water tank;

b) operating the heat pump when the tank temperature falls below the normal predetermined tank temperature;

c) detecting the refrigerant temperature in the condenser heat exchanger;

d) when the refrigerant temperature in the condenser heat exchanger exceeds a first prescribed temperature corresponding to a water temperature sufficient for immediate use but below the normal predetermined tank temperature, circulating the water from the lower end of the tank to the heat exchanger and from the heat exchanger to the upper end of the tank until the refrigerant temperature is lowered a prescribed amount;

e) stopping the circulating of the water through the heat exchanger when the refrigerant temperature has been lowered said prescribed amount; and, f) repeating steps d) and e) until the normal predetermined tank temperature is reached.

11. The method of claim 10 wherein said first prescribed temperature corresponds to a water temperature in the heat exchange of about 125°-140° F. and said prescribed amount the refrigerant temperature is lowered is about 15° F.

12. The method of claim 11 wherein the predetermined tank temperature is about 140° F.

13. The method of claim 10 wherein said first prescribed temperature is about 140° F.

14. The method of claim 10 wherein step b) includes heating the water in the heat exchanger at a rate less than that required to heat the water to the normal predetermined tank temperature while circulating through the heat exchanger in step d).

15. The method of claim 10 wherein step d) includes circulating the water through the heat exchanger at a flow rate such that the water temperature in the heat exchanger drops below a water temperature sufficient for immediate use when the water a the lower end of the tank is cold.

* * * * *